US005507483A

United States Patent [19]

Hektor

[11] Patent Number: 5,507,483

[45] **Date of Patent: *Apr. 16, 1996**

[54] APPARATUS FOR RETURNING BASKETBALLS TO FREETHROW LINE

[76] Inventor: Otto L. Hektor, 250 E. Old Elm Rd., Lake Forest, Ill. 60045

[ * ] Notice: The term of this patent shall not extend beyond the expiration date of Pat. No. 5,333,853.

[21] Appl. No.: 502,116

[22] Filed: Jul. 13, 1995

[51] Int. Cl.[6] ..... A63B 69/00

[52] U.S. Cl. ..... 273/1.5 A

[58] Field of Search ..... 273/1.5 A, 395–397

[56] References Cited

U.S. PATENT DOCUMENTS 3,901,506 8/1975 Caveney ..... 273/1 RA 4,869,502 9/1989 Wares ..... 273/1.5 A 5,246,225 9/1993 Matherne et al. ..... 273/15 A 5,333,853 8/1994 Hektor ..... 273/1.5 A 5,374,054 12/1994 Suess ..... 273/1.5 R

*Primary Examiner*—Paul E. Shapiro

*Attorney, Agent, or Firm*—Richard L. Huff

[57] ABSTRACT

An apparatus for returning basketballs falling in front of the backboard to a shooter at the freethrow line. The apparatus may be mounted to the backboard, a free-standing post supporting the backboard, or to the hoop bracket. The apparatus contains a closed frame which bends down away from the backboard. The closed frame supports a return surface such as webbing or sheeting. Sidestops are rotatably and removably secured to the closed frame for the purpose of ensuring the return of more balls which fail to go through the hoop. The apparatus may be easily attached for use, detached following use or swung into an out-of-the way storage position.

12 Claims, 2 Drawing Sheets

APPARATUS FOR RETURNING BASKETBALLS TO FREETHROW LINE

BACKGROUND OF THE INVENTION

1. Field of the Invention

This invention relates to an apparatus which returns basketballs from the vicinity of the backboard to the shooter at the freethrow line.

2. Description of the Related Art

Prior to the present invention, there has been a continuing need for a basketball return apparatus which is easily mountable near a basketball hoop and adapted to return the ball to the freethrow line in a manner which simulates the throwing of the ball by the official. There has been an accompanying need that such apparatus not be cumbersome and can be easily storable and/or retractable, yet light in weight and simple to handle. There has also been a need for such apparatus to return those balls which fail to fall through the hoop as well as those that do pass through the hoop. My prior invention, as set forth in U.S. Pat. No. 5,333,853, met many of these needs. It has been found that even with the advances made in the above patent, some basketballs bounce away from the hoop and fail to be captured by my prior apparatus. This invention is designed to provide an apparatus which will capture a greater percentage of balls which do not fall through the hoop, and thus represents an improvement over my prior patent.

SUMMARY OF THE INVENTION

The present invention takes as a starting point, the apparatus disclosed in my earlier U.S. Pat. No. 5,333,853, the disclosure of which is incorporated herein by reference. The earlier apparatus is a basketball return apparatus comprising a closed frame comprising a proximal member, two side members, and a distal member. The closed frame is covered by a return surface which returns a basketball to the shooter at the freethrow line. The closed frame is detachably attached to, and is supported by, side members of a main hanging brace. The earlier apparatus may contain two backstop members, one located on each side of the main hanging brace. These backstop members are also covered with a return surface to direct the basketball to the closed frame. Additional features of the earlier apparatus are its ability to be locked in an operative position, easily swung out of the way, or easily removed. A wide variety of mounting brackets may be used with the earlier apparatus. The present invention adds side stops to the earlier apparatus. There are two side stops, one mounted on each of the two side members of the closed frame. These side stops are covered with a return means. The side stops are rotatable about the side members of the closed frame, and may be locked into one of several available positions to widen or narrow the scope of the capture area.

DESCRIPTION OF THE PREFERRED EMBODIMENTS

Figure 1:
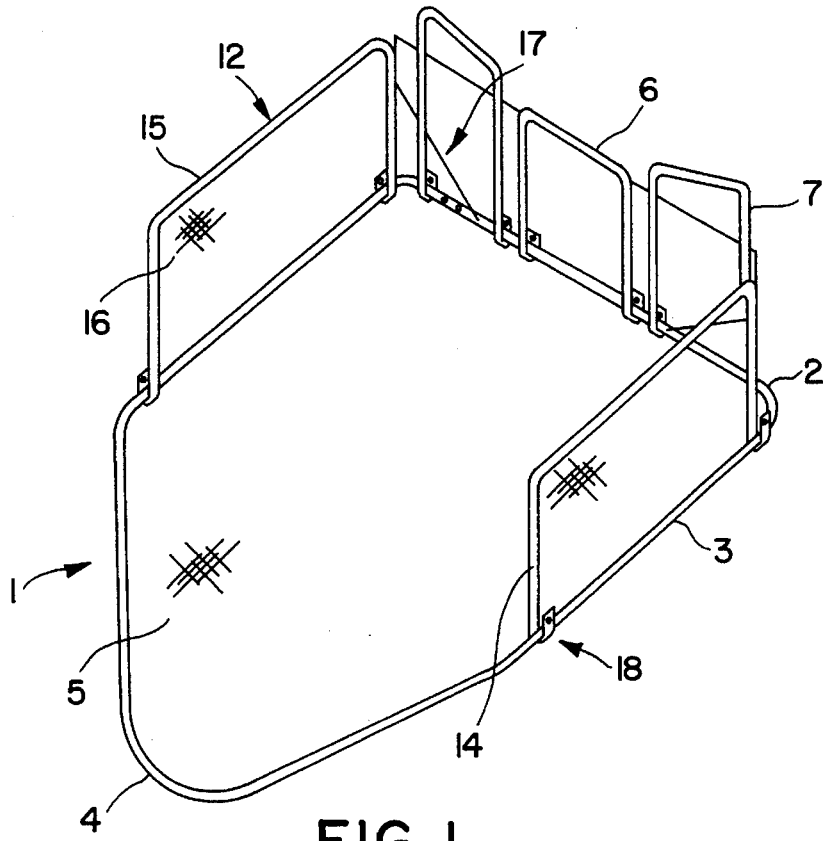
FIG. 1 is perspective view of the apparatus of the present invention, showing the side stops in a vertical position.
Figure 2:
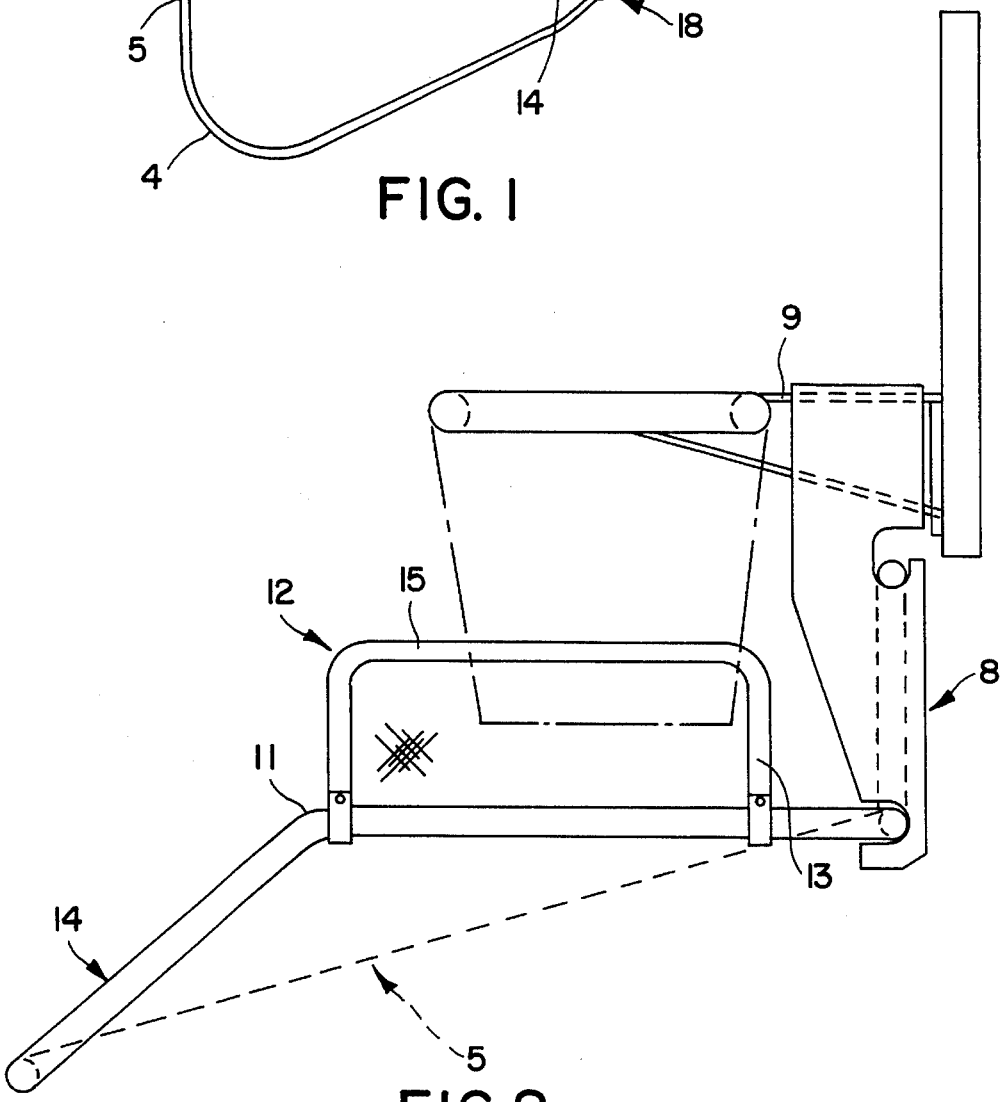
FIG. 2 is a side elevational view of the apparatus of the present invention mounted in an operative position.
Figure 3:
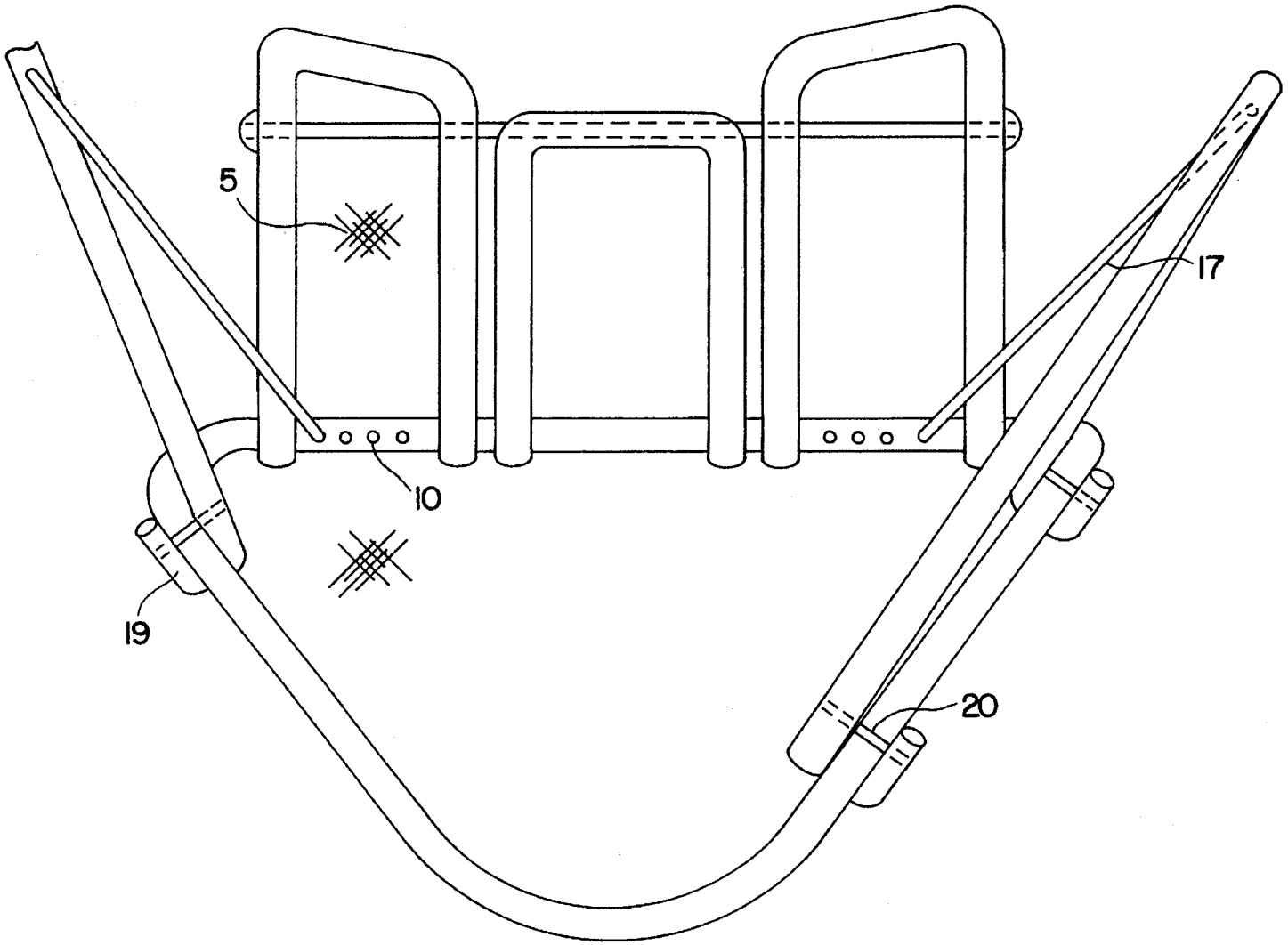
FIG. 3 is a front elevational view of the apparatus of the invention, showing the adjusting arms. For clarity, the top and distal members of the left side stop have been omitted.

For convenience, like parts have been given the same numbers in the several Figures.

The Figures show the closed frame 1 having a proximal member 2, two side members 3, and a distal member 4. The closed frame 1 is covered by a return surface 5. The proximal member 2 of the closed frame 1 is attached to a main hanging brace 6 and two backstops 7. The main hanging brace 6 may be attached by means of a mounting bracket 8 to a hoop bracket 9. Each of the backstops 7 is covered by a return surface 5. The proximal member 2 of the closed frame 1 contains a plurality of locking means 10. Any conventional locking means is suitable, but for simplicity of design and ease of construction, a plurality of openings bored into the proximal member 2 has been found to be satisfactory.

The side members 3 of the closed frame 1 contain a downwardly sloping angle 11. A side stop 12 is mounted on each side member 3 between the angle 11 and the proximal member 2. Each side stop 12 contains a proximal member 16, a distal member 14, and a top member 15. Each side stop 12 is covered by a return means 16, which may be the same or different from the material used as the return surfaces 5 in the closed frame I and the backstops 7. Thus, cloth or plastic sheeting or rope or plastic webbing may be successfully used. The proximal member 13 of each side stop 12 contains an adjusting arm 17 moveably attached thereto near the top member 15. Each adjusting arm 17 has a proximal end and a distal end. The proximal end of each side stop 12 contains the distal end of an adjusting arm 17 rotatably attached thereto at a point near the top edge 15 of the side stop 12. The proximal end of each adjusting arm 17 is connected to a locking means 18 on the proximal member 2 of the closed frame 1. The proximal 13 and distal 14 members of each side stop 12 are rotatably attached to the side members 3 of the closed frame 1. Any suitable means of attachment is satisfactory for purposes of the present invention. A particularly suitable attachment means 18 has been found to be made up of a "J"-shaped extension 19 of the proximal 13 and distal 14 members of the side stops 12, which are of such size and shape as to be capable of swinging around the side member 3 of the closed frame 1. Locking means 20 are used to keep the side stops 12 in place. Examples of suitable locking means 20 are a steel bolt and a cotter pin.

The basketball return apparatus of the present invention may be readily and cheaply manufactured, easily mounted, easily stored in an out-of-the-way position, and easily dismounted. The angle of the side stop 12 may be easily adjusted by connecting the adjusting arms 17 to different locking means 18. Because of the addition of the side stop 12 to the apparatus of my earlier invention, nearly all the basketballs thrown from the freethrow line are returned to the shooter in a manner simulating a ball thrown by an official.

I claim:

1. An apparatus for returning basketballs from a position under or adjacent to a basketball hoop having a hoop bracket and mounted on a backboard in a direction toward a corresponding freethrow line, which apparatus comprises:

(1) a closed frame comprising (a) a proximal member having a side-to-side dimension which is about the same as the side-to-side dimension of the backboard, (b) a distal member having the shape of a rounded "V", and (c) two side members, proceeding from the proximal member to the distal member, each of the side members containing an angle in a downward direction; each side member, proximal to the downward angle, containing a rectangular side stop; each of the two side stops extending substantially from the proximal end of the side member to the downward angle; each side stop containing a distal end, a top edge, a proximal end and a return means;

(2) a return surface being a single continuous member having a central axis and being connected on all sides to the closed frame so that, when in the operating position, the return surface slopes downwardly from the sides to the central axis and slopes downwardly from the proximal end to the distal end under the weight of the basketball; and (3) a main hanging brace comprises an upper member and two side members, the upper member being above and parallel to the proximal member of the closed frame; and the two side members of the main hanging brace having upper and lower ends, the lower ends being "J" shaped and capable of holding the proximal member of the closed frame, the lower ends of the side members of the hanging brace and the proximal member of the closed frame being provided with openings which are aligned to provide access by a locking device.

2. The apparatus of claim 1, wherein the proximal member of the closed frame is provided with a double set of openings so arranged as to allow securing of the closed frame in an outward position allowing for the return of basketballs and a downward position for storage.

3. The apparatus of claim 1, wherein a rod is extended through the upper member of the main hanging brace in a direction parallel to the proximal member of the closed frame, a backstop is mounted on the rod on each side of the main hanging brace, each backstop containing an upper member and two side members, the upper member being above the proximal member of the closed frame, the two side members having upper and lower ends, the lower ends being "J"-shaped and capable of holding the proximal member of the closed frame, the lower ends of side members of the backstops being provided with aligned openings to provide access by a locking device for securing the proximal member of the closed frame, each backstop being provided with a return surface for directing basketballs toward the return surface of the closed frame.

4. The apparatus of claim 1, wherein the backboard is mounted on a free-standing post, a backplate is mounted to the post below the backboard, a "U"-bracket is mounted on the backplate, and the upper member of the main hanging brace rests in the "U"-bracket.

5. The apparatus of claim 1, wherein a backplate and an "S"-bracket are mounted on the backboard in such a manner that a "U"-shaped slot is formed between the backboard and the "S"-bracket, and the upper member of the main hanging brace rests in the "U"-shaped slot.

6. The apparatus of claim 1, wherein a hanging bracket is mounted on the hoop bracket, which hanging bracket has a top member which rests upon the hoop bracket and two leg members, each of the leg members containing an upper vertical segment which has a proximal aspect having a locking notch therein, an outwardly and downwardly sloping middle segment and a lower segment which has a horizontal plane containing a "U"-shaped opening, the upper member of the main hanging brace resting in the locking notches and the two side members of the main hanging brace being held by the two "U"-shaped openings of the bottom segments of the legs.

7. The apparatus of claim 6, wherein the hanging bracket is made of sheet material.

8. The apparatus of claim 6, wherein the hanging bracket is in the form of a wire.

9. The apparatus of claim 1, wherein the return surface is made of rope webbing, cloth sheeting or plastic sheeting.

10. The apparatus of claim 1, wherein the proximal member of the closed frame contains a plurality of locking means, the apparatus contains two adjusting arms, each adjusting arm having a proximal end and a distal end, the proximal end of each side stop contains the distal end of an adjusting arm rotatably attached thereto at a point near the top edge of the side stop, and the proximal end of each adjusting arm is connected to a locking means located on the proximal member of the closed frame.

11. The apparatus of claim 10 wherein the locking means on the proximal members of the closed frame are openings penetrating the frame and the proximal end of the adjusting arm is shaped to fit into the locking means.

12. The apparatus of claim 1, wherein the proximal and distal ends of each side stop contain "J"-shaped members which fit around the two side members of the closed frame, there being securing devices attached to the "J"-shaped members to removably and rotatably secure the side stops to the side members of the closed frame.

* * * * *